United States Patent [19]

Capp et al.

[11] Patent Number: 4,934,960

[45] Date of Patent: Jun. 19, 1990

[54] CAPACITIVE COUPLED CONNECTOR WITH COMPLEX INSULATIVE BODY

[75] Inventors: Randolph E. Capp, Mechanicsburg; Tracy L. Smith, Harrisburg, both of Pa.

[73] Assignee: AMP Incorporated, Harrisburg, Pa.

[21] Appl. No.: 461,133

[22] Filed: Jan. 4, 1990

[51] Int. Cl.[5] ..... H01R 13/66

[52] U.S. Cl. ..... 439/620; 439/578; 333/185

[58] Field of Search ..... 439/620, 578; 333/181–185

[56] References Cited

U.S. PATENT DOCUMENTS

| | | | |
|---|---|---|---|
| 3,089,115 | 5/1963 | Wicks | 439/578 |
| 3,932,020 | 1/1976 | Gilbert, Jr. | 439/578 |
| 4,772.221 | 9/1988 | Kozlof | 439/620 |
| 4,797,120 | 12/1987 | Ulery | 439/578 |
| 4,799,900 | 4/1988 | Capp et al. | 439/585 |
| 4,884,982 | 4/1989 | Fleming et al. | 439/620 |

OTHER PUBLICATIONS

"LAN Coaxial Braid Filter Connectors", National Tel-tronics Company, pp. 1–4.

"Microwave and RF Coaxial Connectors", Radiall Company, p. VII.

*Primary Examiner*—Gary F. Paumen

[57] ABSTRACT

Capacitive coupled connector 1 for mounting to a conductive panel comprises an insulative dielectric skirt section 25, a conductive shell 2 within the insulative body 25 and having cylindrical wall 6 with coupling portion for coupling the shell to the panel, an insulative dielectric liner section 26 within the conductive shell 2, a conductive contact 4 extending within the liner section 26, electrical capacitor elements 46 and 47 inset within the outer profile of the connector 1, and conductive clip 5 retaining the capacitor elements 46 and 47 in pressure contact with the shell 2, contact surfaces of the clip establishing a capacitive electrical coupling of the shell 2 and the panel. the insulative outer skirt section 25 and the insulative dielectric liner section 26 form a complex insulative body 3 having interconnecting sections 27 and 28 through apertures 23 and 24 in the cylindrical wall 6 of the conductive shell 2. The clip 5 is an annular disc 48 residing on a skirt portion 25 of the insulative body and has helical arms 49, 50, 51, and 52 circumferential to the disc 47 to establish conductive paths to the panel, and clip fingers retaining the capacitor elements 46 and 47 in pressure contact with the shell 2.

4 Claims, 5 Drawing Sheets

CAPACITIVE COUPLED CONNECTOR WITH COMPLEX INSULATIVE BODY

FIELD OF THE INVENTION

The invention relates to an electrical connector for connection to a conductive panel, the connector providing a capacitive coupling to the panel and a voltage discharge path, the connector characterized by a complex insulative body. The invention also relates to a method of assembling the connector.

BACKGROUND OF THE INVENTION

U.S. Pat. No. 4,797,120 discloses a known connector for mounting to a conductive panel and comprising, an insulated signal transmitting contact, an insulated conductive shell and a coupling portion for coupling the shell to the panel. The coupling portion is a device with an electrical filter and is externally secured to an electrical connector without regard to whether the device is within the profile of the connector. U.S. Pat. No. 4,884,982 discloses a capacitive coupling including a conductive clip adapted to the outer profile of an electrical connector and providing a capacitive coupling with multiple conduction paths through capacitor elements held by the clip in pressure engagement with a conductive shell of the connector; the clip further providing a voltage discharge path between the clip and the shell.

A feature of the invention of U.S. Pat. No. 4,884,982 is that the electrical connector is of an outer profile having the same dimensions as that of known connectors without the capacitor elements. By maintaining the same outer dimensions, the connector with the capacitive coupling feature is easily substituted for the standard connector for use in an allotted confined space. Further features of the invention of U.S. Pat. No. 4,884,982 include a conductive clip which is inset along the outer limits of the outer profile of the connector. The clip holds the electrical capacitor elements in pressure engagement against the conductive shell of the connector to provide capacitive coupling of the shell and an external conductive panel contacting the connector. The clip exerts a spring force to maintain pressure engagement of the capacitor elements against the shell despite the force reducing effect of torque applied to the connector, metal creep to relieve stress and other dimensional changes with the passage of time. The structure provides a clip having multiple, spaced apart contact surfaces distributed along the clip to provide distributed electrical coupling paths from the shell through the capacitor elements into a conductive panel contacting the clip. The distributed electrical paths reduce the likelihood of high electrical resistance at the coupling of the connector with the panel. The clip further provides a voltage discharge path between the clip and the shell.

SUMMARY OF THE INVENTION

The present invention relates to a capacitive coupled connector within the family of connectors of U.S. Pat. No. 4,797,120 and U.S. Pat. No. 4,884,982 having a capacitive coupling feature. An objective of the present invention is to provide a connector that may be mounted with a metal chassis or housing over the connector and having means to ground the connector to the chassis. Another objective of the present invention is to provide a connector having a unique complex insulative body which may be manufactured more economically than capacitive connectors currently known in the art.

According to one feature of the present invention, the capacitive coupled electrical connector is characterized by an insulative dielectric outer skirt encircling a conductive shell. Another feature of the present invention is a complex insulative body which is formed by injection molding in situ with the conductive shell of the connector.

The present invention is a capacitive coupled electrical connector for mounting to a conductive panel comprising an insulative dielectric outer skirt section, a conductive shell within the insulative section and having cylindrical walls with coupling portion for coupling the shell to the panel, and insulative dielectric liner section within the conductive shell, a conductive contact extending coaxially within the liner section, electrical capacitor elements inset within the outer profile of the connector, and conductive clip maintaining the capacitor elements in pressure contact with the shell, contact surfaces of the clip establishing a capacitive electrical coupling of the shell and the panel. The capacitive shell has apertures through its cylindrical wall section and the insulative outer skirt section and the insulative dielectric liner section form a complex insulative body having interconnecting sections through the apertures in the cylindrical wall.

The present invention also relates to a method for assembling the capacitive coupled electrical connector from component parts which include an insulative dielectric outer skirt section, a conductive shell having walls with apertures, an insulative dielectric liner section, a conductive contact, conductive clips and capacitor elements. By the method, the conductive center contact is inserted into a receiving passageway within the dielectric liner section of a combination of conductive shell encompassing a dielectric liner section and outer skirt section encircling and concentric to the shell, inserting capacitor elements within cavities of the outer profile of the shell, encircling the shell with a conductive clip, and securing the capacitor elements by compression of the clip against the elements. The improvement comprises forming the combination of conductive shell, dielectric liner section and outer shirt section by simultaneously molding together the insulative dielectric outer shirt section and insulative dielectric liner section in situ with the conductive shell and through the apertures of the shell to produce the combination of shell and unitary complex insulative body formed from said skirt section, said liner section and interconnecting dielectric sections.

These and other advantages, features and objectives of the invention are disclosed by way of example from the following description and accompanying drawings.

FIG. IA is a perspective view of the conductive clip of the connector.

Figure 1:
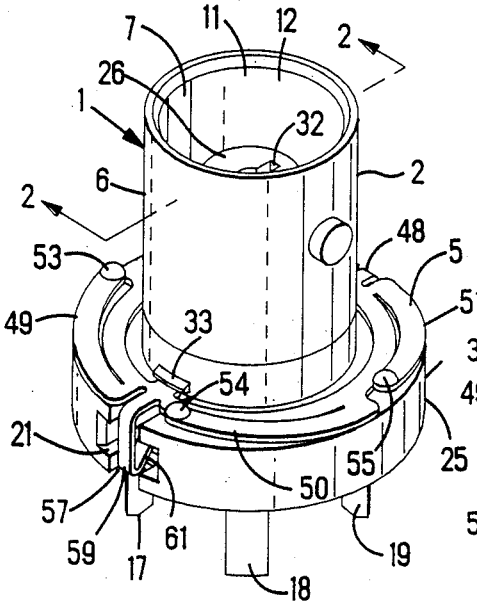
FIG. 1 is a perspective view of a connector adapted for providing a capacitive coupling to a panel.
Figure 1A:
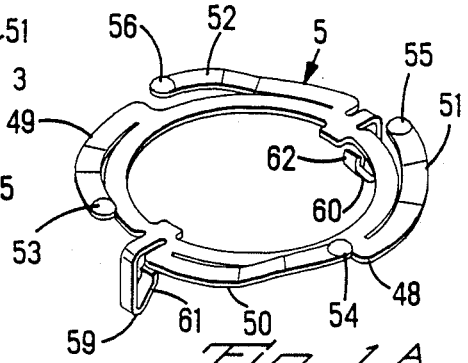
Figure 2:
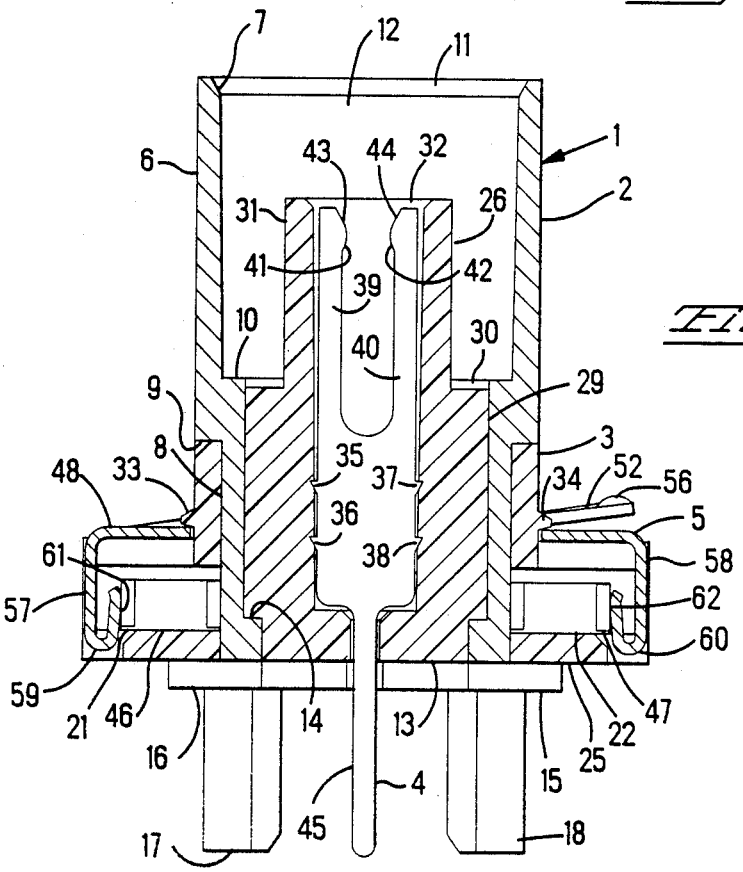

FIG. 2 is a section view of the connector taken along the line A—A of FIG. 1.

Figure 3:
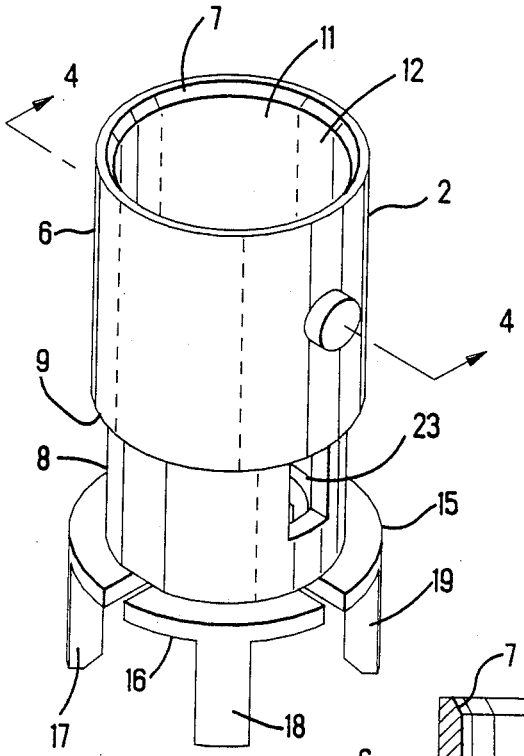

FIG. 3 is a perspective view of the conductive shell disassembled from the connector of FIG. 1.

Figure 4:
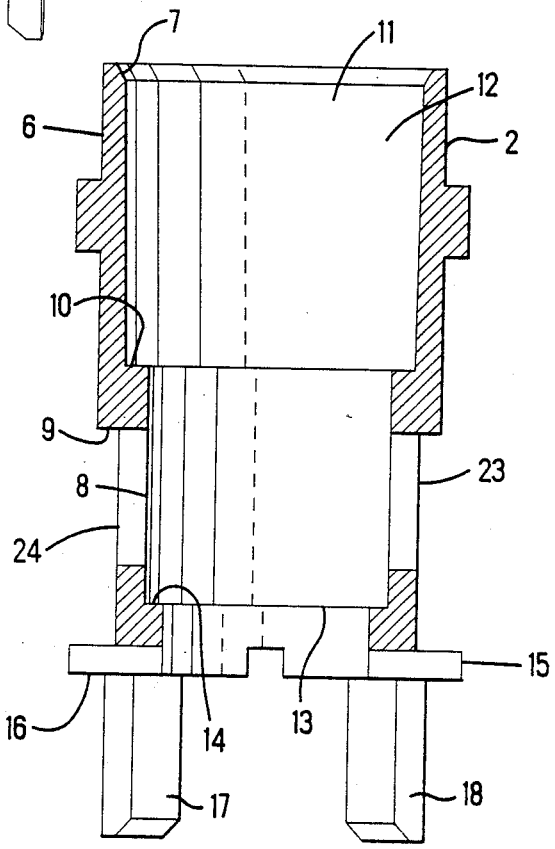

FIG. 4 is a section view of the shell of FIG. 3, taken along the line B—B.

Figure 5:
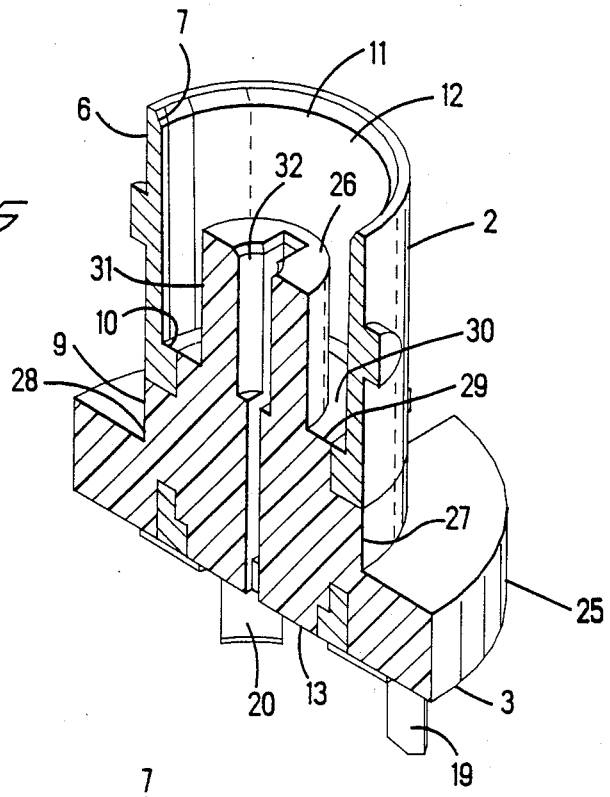
Figure 6:
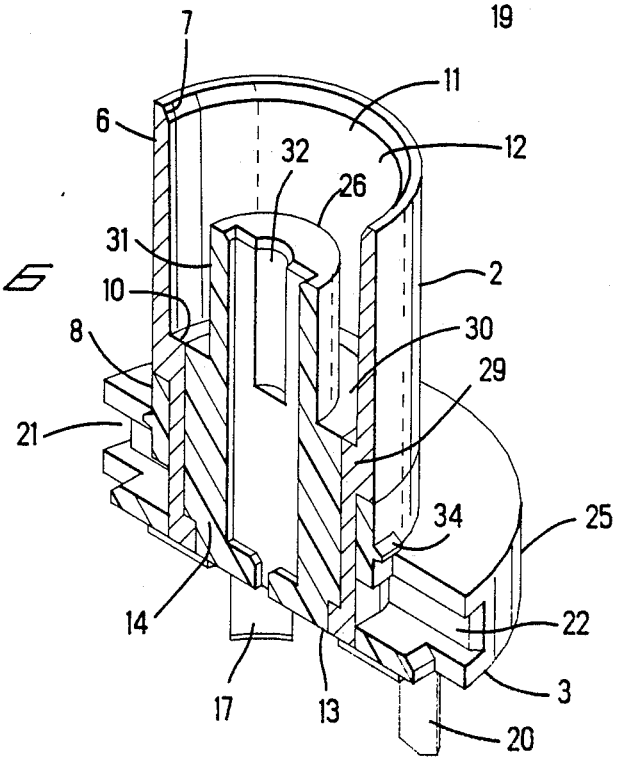

FIGS. 5 and 6 are perspective views of the combined insulative body and conductive shell, only, of the connector of FIG. 1, along lines 90 degrees apart.

Figure 7:
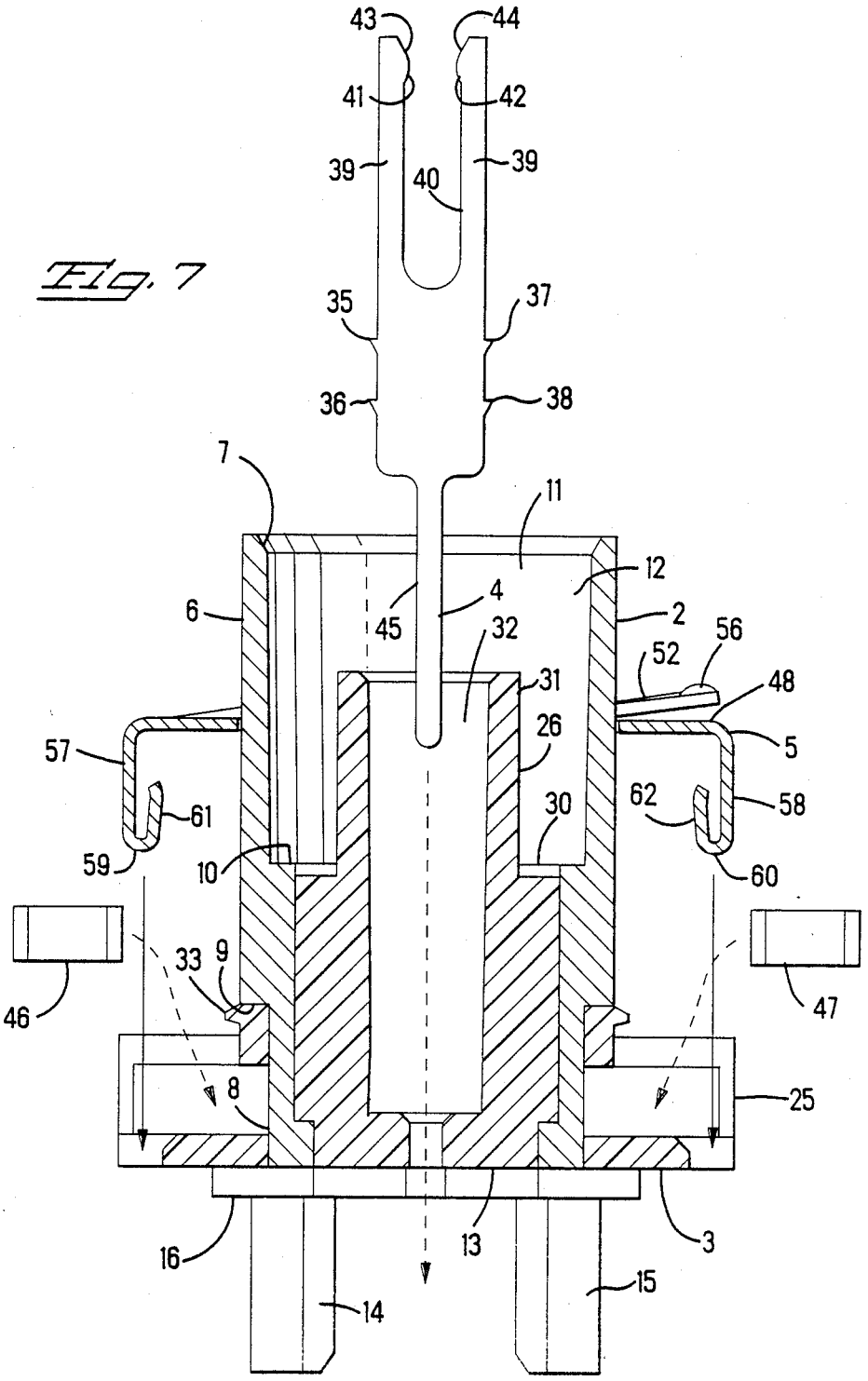

FIG. 7 is a section view of the connector of FIG. 1 during assembly.

Figure 8:
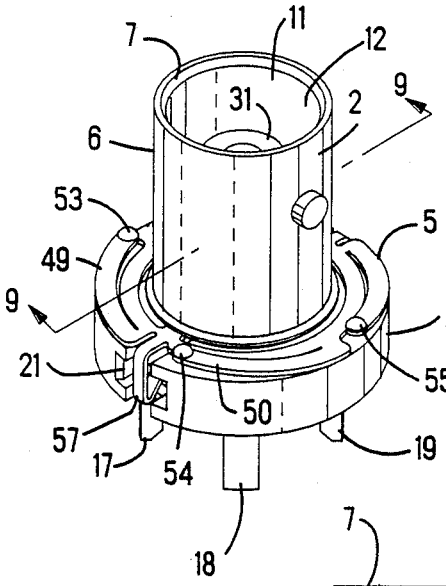

FIG. 8 is a view similar to FIG. 1 and illustrating a connector of a jack type.

Figure 9:
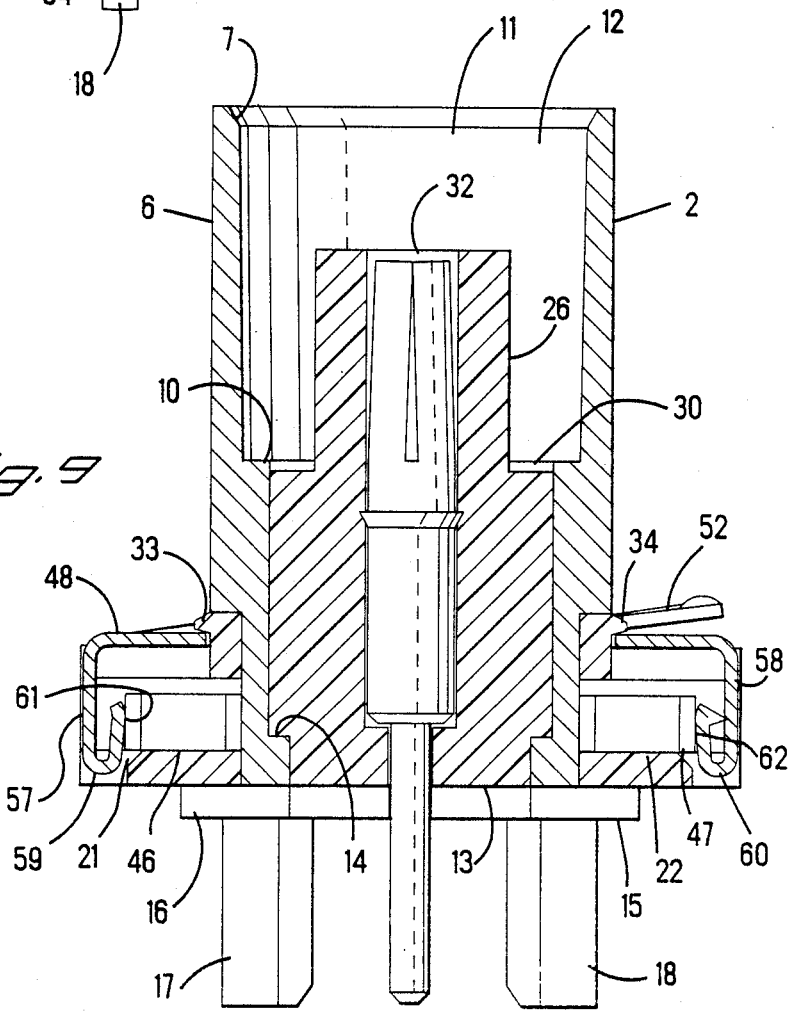

FIG. 9 is a view similar to FIG. 2 and illustrating the connector of FIG. 8.

DETAILED DESCRIPTION OF THE INVENTION

With reference to FIGS. 1 and 2 is shown an electrical connector 1 for connection to a conductive panel. The connector 1 comprises a conductive shell 2, a complex insulative body 3, a conductive contact 4, and a conductive clip 5.

Referring to FIGS. 1 through 7, conductive shell 2 has a substantially cylindrical-shaped body with upper cylindrical section 6 and beveled upper lip 7, lower cylindrical section 8 of smaller outer diameter which in connection one-to another, forms outer shoulder 9 and inner shoulder 10. Shell 2 is characterized by axial bore 11 with upper disconnect coupling chamber 12 and lower chamber 13 of smaller inner diameter than that of upper chamber 12 and with annular flange 14 meeting base 15 which is a round platform 16 with a plurality of integral conductive posts 17, 18, 19, and 20. The outer profile of connector 1 is characterized by cavities 21 and 22 formed within insulative body 3. Of particular significance with regard to the structure of shell 2 are apertures 23 and 24 through the wall of lower cylindrical section 8, which apertures 23 and 24 permit formation of complex insulative body 3, in accord with the present invention, and as hereinafter described.

As particularly shown in FIGS. 5 and 6, insulative body 3 is characterized as a complex body in that it consists of a composite of interconnected sections—insulative dielectric outer skirt section 25, insulative dielectric liner section 26, and interconnecting sections 27 and 28—residing within the reticulate structure created by apertures 23 and 24 within conductive shell 2. Skirt section 25 has cavities 21 and 22 to receive capacitor elements 44 and 45, as hereinafter described. Liner section 26 extends within the axial stepped bore 11 concentrically of the shell 2. Lower portion 29 has stepped profile forming annular shoulder 30 engaging the front facing of annular flange 14. Forward portion 31 of the liner section 26 is of reduced diameter and projects concentrically into the disconnect coupling chamber 12 of shell 2.

Conductive electrical contact 4, known as a center contact, extends coaxially within the liner along passageway 32, secured therein by the imposition of barbs 35, 36, 37, and 38 against the walls of passageway 32. The contact is of unitary construction stamped from a metal strip and formed into the shape of a fork. The fork tines 39 and 40 of contact 4 are resilient and terminate with jaws 41 and 42, with beveled leading edges 43 and 44 so designed to receive and retain a pluggable contact of a complimentary electrical coupler. Contact 4 terminates in an elongated flat handle 45 of the fork shape for projecting through the housing of electrical equipment for establishing electrical contact.

Connector 1 is adapted with a conductive clip 5 and multiple capacitor elements 46 and 47 to provide a capacitive coupling of the shell 2 with a conductive panel. As disclosed by U.S. Pat. No. 4,884,920, the capacitive coupling will discharge a voltage from shell 2 to the conductive panel and will allow a voltage of the shell to be capacitive coupled with a corresponding voltage of the panel.

According to FIGS. 1 and IA, the clip 5 is fabricated from a stamped and formed unitary metal strip of relatively thin thickness. The clip 5 is an annular disc 48, fitting coaxially with to conductive shell 2, resting on skirt section 25 of complex insulative body 3 and snapped-in-place by tabs 33 and 34 of insulative body 3. Helical arms 49, 50, 51, and 52, distributed along disc 48 and longitudinally thereto, extend from the disc 48, terminating with Hertz dots 53, 54, 55, and 56 to engage the panel and to establish conductive paths thereto. Beams 57 and 58, integral to the structure of the clip 5, extend from two sides, bending downward and folded back to form U-shaped sections 59 and 60, resilient, to provide biasing surfaces 61 and 62. The U-shaped sections 59 and 60 are inset within receptacles 29 and 30 of insulative body 3 to engage and hold capacitor elements 46 and 47. Clip 5 exerts a spring force to maintain pressure engagement of each corresponding capacitor element 44 and 45 with the shell 2 and with clip 5.

With particular reference to FIGS. 5, 6, and 7, an aspect of the present invention relates to a method for assembling the connector 1. Conductive center contact 4 is inserted into receiving passageway 32 within the dielectric liner section 26 of the complex insulative body 3. Capacitive elements 46 and 47 are inserted within cavities 21 and 22 of the outer profile of the shell 2. The shell 2 is encircled with the conductive clip 5 and the capacitor elements 46 and 47 are secured within the cavities 21 and 22 by the compression of biasing surfaces 61 and 62. Characteristic of the method is that the insulative dielectric outer skirt section 25 and the insulative dielectric line section 26 are simultaneously molded together, in situ or in place with the conductive shell 2 and through the apertures 23 and 24, of the shell 2 to produce the combination of the unitary complex insulative body 3 formed from the skirt section 25, liner section 26 and interconnecting dielectric sections 27 and 28, reticulated within the structure of shell 2.

Other forms of the electrical connector 1 are within the scope of the present invention. For example, conductive contact 4, illustrated in fork shape in the Figures, may be a jack type connector of the PCB type, as shown in FIGS. 8 and 9, having either male or female contact. Because the invention can take numerous forms, it should be understood that the invention is limited only insofar as is required by the scope of the following claims:

We claim:

1. Capacitive coupled electrical connector for mounting to a conductive panel, comprising: an insulative outer skirt section, a conductive shell within the insulative skirt section and having a cylindrical wall, an insulative liner section within the conductor shell, a conductive contact extending within the liner section, electrical capacitor elements inset within the outer profile of the connector, a conductive clip retaining the capacitor elements in pressure contact with the shell, contact surfaces of the clip establishing a capacitive electrical coupling of the shell and the panel wherein:

the coupling shell has apertures through its cylindrical wall, and the insulative outer skirt section and the insulative liner section form a unitary complex insulative body having interconnecting sections through the apertures on the cylindrical wall, and wherein:

the conductive clip is an annular disc residing on the skirt section of the unitary complex insulative body and encircling the conductive shell.

2. The electrical connector of claim 1, wherein the clip is an annular disc having helical arms circumferential to the disc and with clip fingers retaining the capacitor elements in pressure contact with said shell.

3. The electrical connector of claim 2, wherein the clip fingers are folded back to provide added resiliency to retain the capacitor elements in pressure contact with said shell.

4. The electrical connector of claim 2, wherein each helical arm terminates with a hertz dot to provide single point contact for a conductive path to the conductive panel.

* * * * *